US005300823A

United States Patent [19]

Ihara

[11] Patent Number: 5,300,823

[45] Date of Patent: Apr. 5, 1994

[54] INTERNAL VOLTAGE DROPPING CIRCUIT FOR SEMICONDUCTOR DEVICE

[75] Inventor: Makoto Ihara, Sakurai, Japan

[73] Assignee: Sharp Kabushiki Kaisha, Osaka, Japan

[21] Appl. No.: 912,997

[22] Filed: Jul. 14, 1992

[30] Foreign Application Priority Data

Jul. 17, 1991 [JP] Japan ..... 3-177030

[51] Int. Cl.[5] ..... G05F 3/16

[52] U.S. Cl. ..... 307/296.3; 307/265; 307/269; 323/315

[58] Field of Search ..... 307/265, 269, 240, 296.3, 307/256, 296.6, 296.4; 323/315, 316, 317; 365/229; 330/254

[56] References Cited

U.S. PATENT DOCUMENTS

| | | | |
|---|---|---|---|
| 3,805,167 | 4/1974 | Nash et al. | 307/265 |
| 3,980,960 | 9/1976 | Hutchinson | 307/265 |
| 4,028,609 | 6/1977 | Detering | 307/265 |
| 4,149,123 | 4/1979 | Richmond et al. | 307/240 |
| 4,313,180 | 1/1982 | Mochizuski et al. | 365/229 |
| 4,904,889 | 2/1990 | Chieli | 307/296.3 |
| 5,006,731 | 4/1991 | Denda | 307/296.3 |
| 5,124,574 | 6/1992 | Ibaraki | 307/296.1 |
| 5,136,260 | 8/1992 | Yousefi-Elezei | 307/605 |

OTHER PUBLICATIONS

Furuyama et al, "A New on-chip Voltage Converter for Submicrometer High-Density DRAM's" IEEE Journal of Solid-State Circuits, vol. SC-22, No. 3, Jun. 1987.

Roberts, Alan L., IEEE International Solid-State Circuits Conference, Digest of Technical Papers, 1987 pp. 252-253.

*Primary Examiner*—William L. Sikes
*Assistant Examiner*—My-Trang N. Ton

[57] ABSTRACT

A control circuit for an internal voltage dropping circuit for a semiconductor load circuit includes a first transistor which turns on or off so as to permit or inhibit current from flowing in the internal voltage dropping circuit in accordance with an active/standby switch signal. A pulsating control signal having a specified duty ratio is generated and coupled to the control circuit while a semiconductor device in the load circuit is in a standby mode. The control circuit is intermittently activated at the specified duty ratio when the semiconductor device is on standby so that a current consumption can be reduced in accordance with the duty ratio.

13 Claims, 8 Drawing Sheets

INTERNAL VOLTAGE DROPPING CIRCUIT FOR SEMICONDUCTOR DEVICE

BACKGROUND OF THE INVENTION

1. Field of the Invention

The present invention relates to an internal voltage dropping circuit for a semiconductor device, and more particularly, it relates to an internal voltage dropping circuit by which current consumption during a standby can be reduced.

2. Description of the Prior Art

In recent years, semiconductor integrated circuits have been increasingly miniaturized. Especially, that is most noticeable in dynamic RAMs. As transistors are miniaturized more and more, supply voltage must be reduced for various reasons, such as lifetime shortening caused by hot electrons. For instance, in transistors of 0.6 μm gate length, supply voltage applied from the outside thereto is 5 V but must be reduced to 4 V or below (e.g., 3.3 V) by use of an internal voltage dropping circuit.

FIG. 8 shows an embodiment of a conventional internal voltage dropping circuit for an integrated circuit semiconductor load device. This circuit employs a current mirror type differential amplifier. The current mirror type differential amplifier 22 consists of two P-type MOSFETs 42 and 43 and two N-type MOSFETs 44 and 45, which are symmetrically arranged on two current paths, and one of the N-type MOSFETs, 44, has its gate connected to a reference potential terminal 24 while the other MOSFET 45 has its gate connected to an output terminal 25. A power source is connected via an output transistor 26 which is a P-type MOSFET to the output terminal 25, and a potential at a junction of the transistors 43 and 45 on the output path in the differential amplifier 22 is applied to a gate of the output transistor 26. There are two paths provided between the differential amplifier 22 and a lower potential power source (the ground in the embodiment in FIG. 8), and a transistor 27 which permits merely a small amount of current to flow is connected to one of the paths i.e. including transistor 44 while a transistor 28 which permits a relatively large amount of current to flow is connected to the other path i.e. including transistor 45.

The internal voltage dropping circuit works as follows. When a potential at the output terminal 25 is lower than that at the reference potential terminal 24, the differential amplifier 22 causes a gate potential at the output transistor 26 to drop, and the output transistor 26 turns on to supply current to the output terminal 25 until the output terminal 25 reaches the same potential as the reference potential terminal 24. The transistors 27 and 28 are for saving the current flowing in the differential amplifier 22, and when an active/standby switch signal 41 received from a control device (not shown) becomes low when a load, such as a CPU and the like, connected to the output terminal 25 is on standby, the transistor 28 turns off, and the transistor 27 permits merely a small current to flow. On the other hand, when the active/standby switch signal 41 becomes high when the load is activated, the transistor 28 turns on to permit a sufficient current to flow in the differential amplifier 22, and the operation speed of the differential amplifier 22 is enhanced.

As has been described, in the conventional internal voltage dropping circuit, even if the semiconductor device 28 is on standby, the transistor 27 permits a small current to always flow by virtue of the gate thereof being coupled to the same power source as transistors 26, 42 and 43, and this wastes electric power.

A power supply circuit having a power-down mode for reducing a current supply to a SRAM as a semiconductor device is disclosed in 1987 IEEE International Solid-State Circuit Conference Digest of Technical Report pp 252–253, "A 256 K SRAM with On-Chip Power Supply Conversion,".

SUMMARY OF THE INVENTION

The present invention provides an internal voltage dropping circuit for a semiconductor device comprising a pulse signal generating means for generating a pulse signal at a specified duty ratio, and a switch means operatively connected to the pulse signal generating means which receives a pulse signal produced by the pulse signal generating means and periodically activates the internal voltage dropping circuit in response to the pulse signal when the semiconductor device is on standby.

In accordance with the present invention, the pulse signal generating means can apply a pulse type control signal to the switch means while the semiconductor device is on stand-by, and accordingly, the switch means can turn on or off at a specified duty ratio so as to or not to permit current to flow in the internal voltage dropping circuit. Thus, a current consumption of the internal voltage dropping circuit is reduced in accordance with the duty ratio unlike a case where an internal voltage dropping circuit permits current to always flow in the circuit.

According to the present invention, the internal voltage dropping circuit works only intermittently at a specified duty ratio while the semiconductor device is on standby, and therefore, the current consumption is reduced in accordance with the duty ratio.

DESCRIPTION OF THE DRAWINGS

An embodiment of the present invention will now be described by way of example and with reference to the accompanying drawings, in which.

DESCRIPTION OF THE PREFERRED EMBODIMENTS

Preferred embodiments of the present invention will be described.

Figure 1:
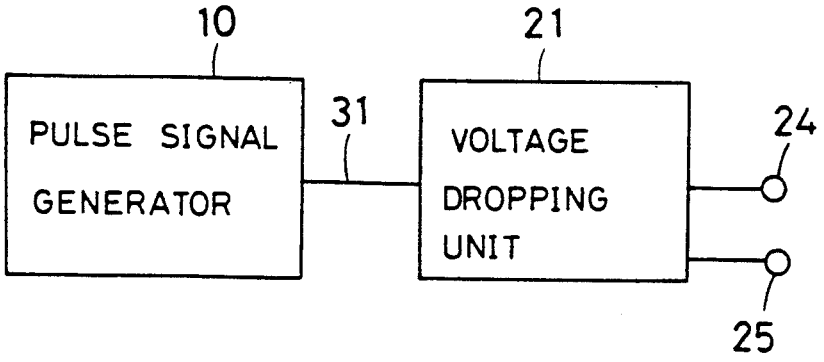
FIG. 1 is a block diagram showing a schematic structure of an internal voltage dropping circuit for a semiconductor device of an embodiment according to the present invention.

FIG. 1 is a schematic block diagram showing a structure of an embodiment of an internal voltage dropping circuit for a semiconductor device according to the present invention. The internal voltage dropping circuit of this embodiment includes a pulse signal generator 10 for outputting a pulse signal on circuit node 31 at a fixed width at constant time intervals, and a voltage dropping unit 21 for dropping voltage only while the pulse signal on node 31 is being input thereto. Terminals 24 and 25 are a reference potential terminal and an output terminal, respectively.

Figure 2:
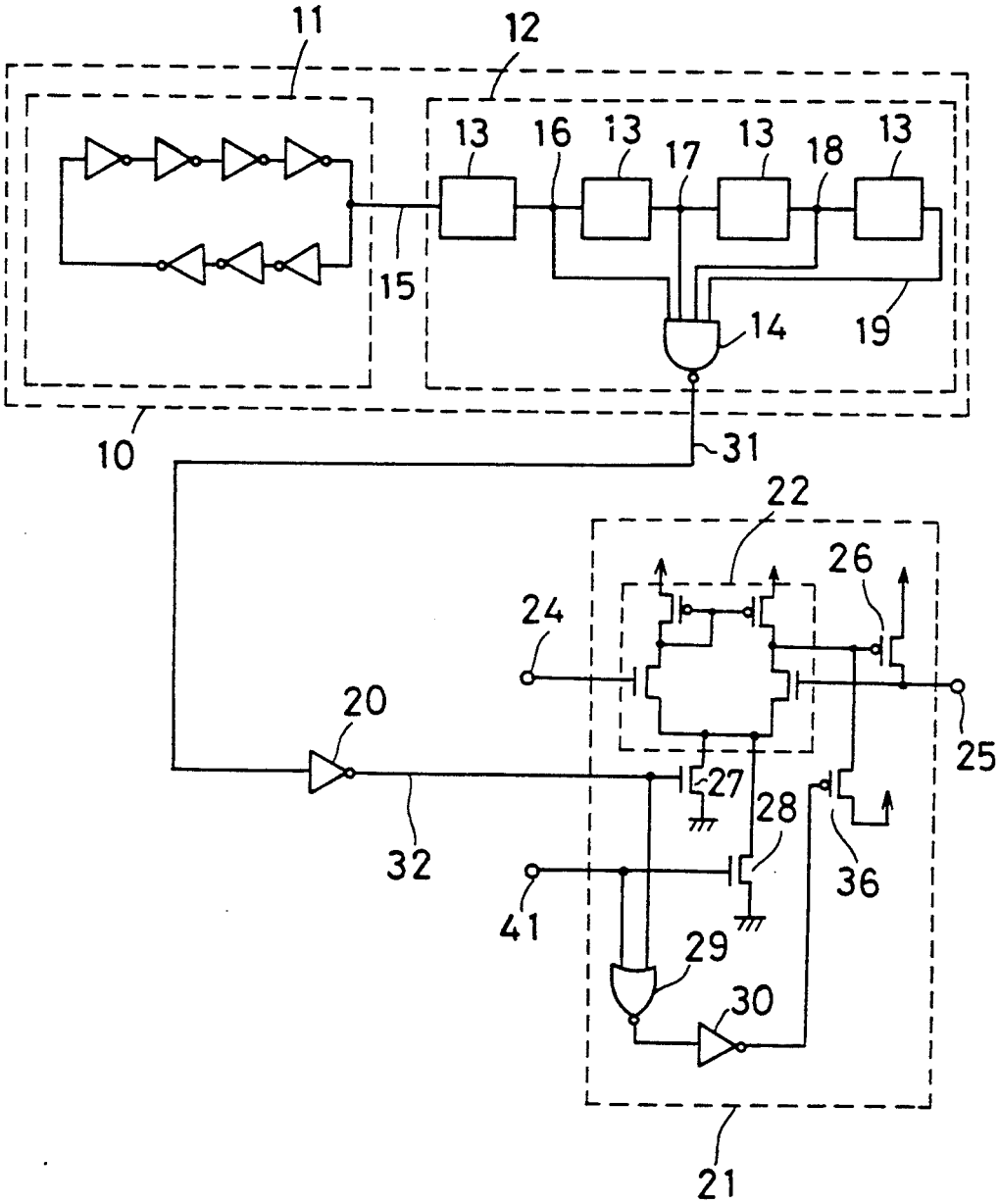
FIG. 2 is a block diagram showing a detailed structure of the internal voltage dropping circuit.
Figure 3:
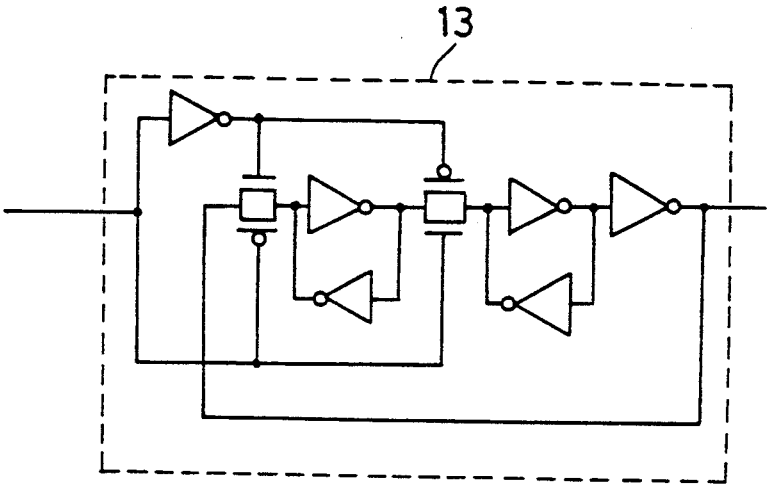
FIG. 3 is a block diagram showing an exemplary structure of a toggle-type flip-flop employed in the embodiment.

FIG. 2 shows a more detailed block diagram of the internal voltage dropping circuit of this embodiment. The pulse signal generator 10 includes a ring oscillator 11 and a counter 12. The ring oscillator 11 is a circuit which has an odd number of inverters connected in series and has an output of the inverter at the final stage connected back to an input of the inverter at the initial stage, whereby repetitive pulse waveforms can be obtained at fixed time intervals. The counter 12 is comprised of four toggle-type flip-flops 13 connected in series, and a four input NAND circuit 14 having four inputs connected to outputs (nodes 16 to 19) of the flip-flops 13 at respective stages. A structure of the flip-flops 13 is shown in FIG. 3. The flip-flop 13 at the initial stage has its input connected to an output (node 15) of the ring oscillator 11.

Figure 8:
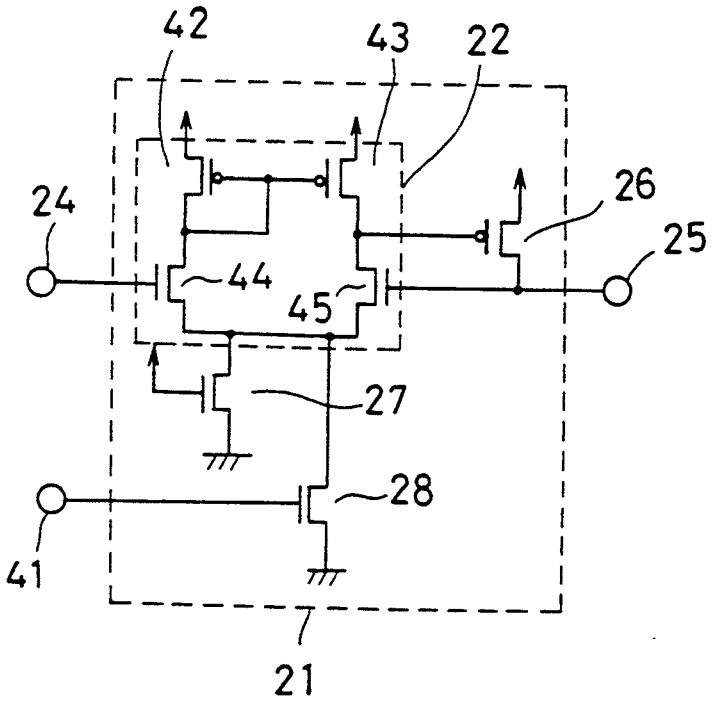
FIG.8 PRIOR ART
FIG. 8 is a block diagram showing a structure of a conventional internal voltage dropping circuit.

The voltage dropping unit 21 has a current mirror type differential amplifier 22 of the same structure as the above-mentioned one in FIG. 8. A transistor (N-type MOSFET) 27 for a small current connected to a lower voltage source (the ground) has its gate (node 32) connected via an inverter 20 to the output (node 31) of the NAND circuit 14, and the output of the NAND circuit 14 is converted by the inverter 20. The output transistor 26 has its gate further connected via a P-type MOSFET 36 to a higher voltage source. Similar to the above-mentioned prior art embodiment, the active/standby switch signal 41 is applied to a gate of a transistor 28. In this embodiment, a serial circuit consisting of a NOR circuit 29 and an inverter 30 is provided, and a signal of the node 32 and the active/standby switch signal 41 are input to the NOR circuit 29. The inverter 30 has its output connected to a gate of the P-type MOSFET 36.

Figure 4:
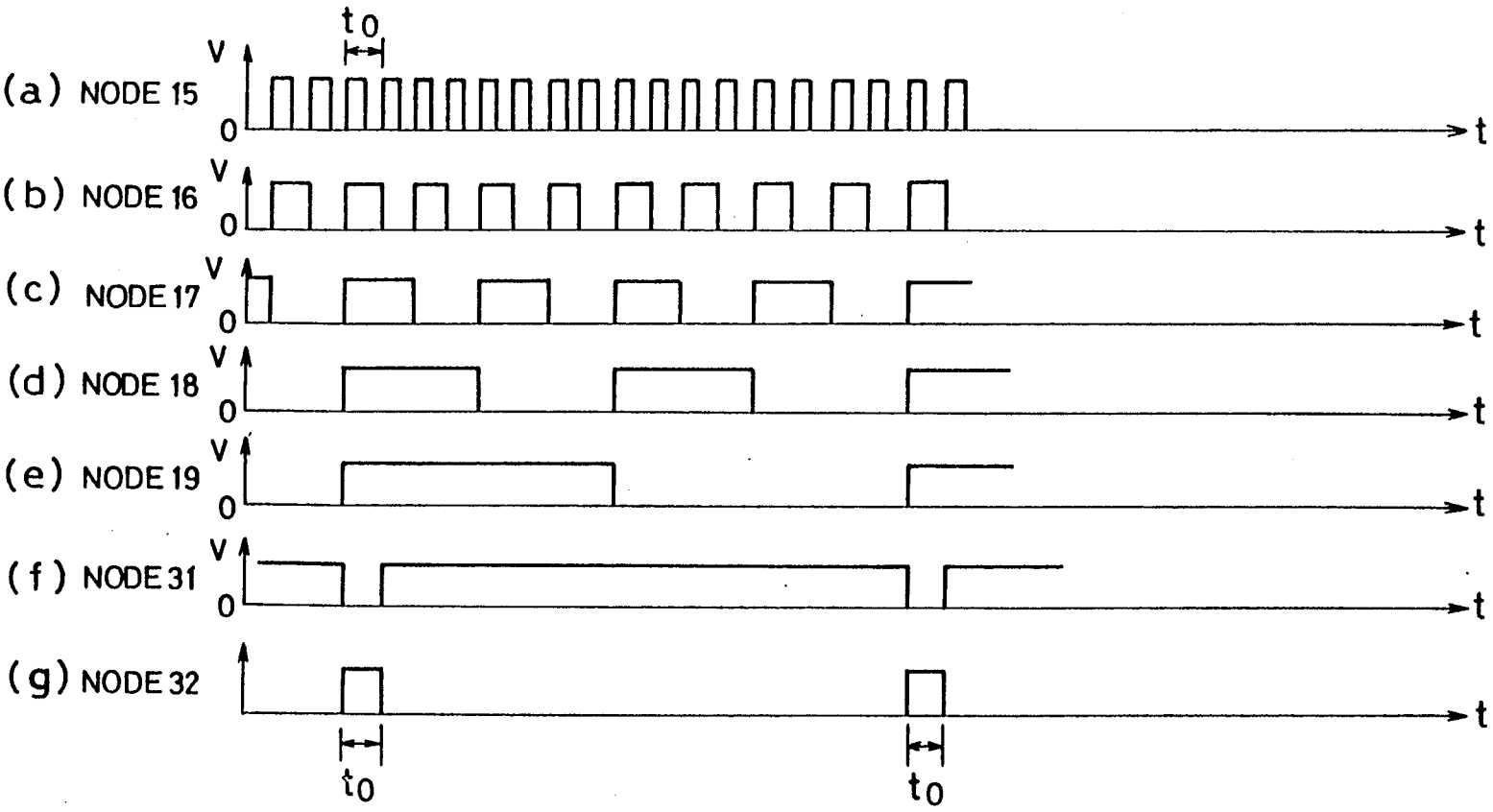
FIG. 4 is a waveform diagram showing pulses at each node in the internal voltage dropping circuit of the embodiment.

Then, with reference to FIG. 4, the pulse signal generator 10 will be described. An original pulse signal (FIG. 4(*a*)) having a cycle $t_0$ produced by the ring oscillator 11 is decreased ½ in frequency, i.e., increased to twice in cycle each time it passes through each toggle-type flip-flop 13 (FIG. 4(*b*) to 4(*e*)). A signal on the node 31, or a NAND of an output of the flip-flop 13 at each stage waits for a cycle sixteen times as large as the cycle $t_0$ of the original pulse signal, as shown in FIG. 4(*f*), and it becomes a pulse signal which turns to low only for a period $t_0$ but turns to high for the remaining period $15t_0$. Thus, a signal of the node 32 converted by the inverter 20 (namely, a gate signal of the transistor 27) becomes a pulse signal which turns to high only for the period $t_0$ in a cycle $16t_0$, as shown in FIG. 4(*g*).

When the semiconductor device in which the internal voltage dropping circuit of this embodiment is on standby, the active/standby switch signal 41 goes to a low level similar to the above-mentioned prior art embodiment, but when it is activated, the signal 41 turns high. First, an operation of the on standby mode will be described. When the active/standby switch signal 41 goes low, the transistor 28 turns off, and only a path via the transistor 27 alone remains as a path to the lower voltage source of the differential amplifier 22. Since the pulse signal of the node 32 shown in FIG. 4(*g*) is applied to the gate of the transistor 27, the transistor 27 turns on only while the signal at the node 32 is high, and the differential amplifier 22 works only when the transistor 27 turns on. Thus, producing a pulse signal of an appropriate duty ratio (mentioned later) in the pulse generator 10, the transistor 27 can be turned on or off after every fixed period of time, and the current flowing in the differential amplifier 22 can be controlled. When the signal at the node 32 turns to low and the transistor 27 turns off, the active/standby signal 41 is also low, and therefore, a transistor 36 turns on. Consequently, the output transistor 26 turns off, and the internal voltage dropping circuit stops its operation.

In this way, in the internal voltage dropping circuit of this embodiment, when the circuit is on standby, its consumption power is reduced to 1/16 as much as a conventional demand.

Additionally, the active/standby switch signal 41 turns to high to turn on the transistor 28 for a large current when the semiconductor device is activated, and the differential amplifier 22 operates at high speed.

Then, setting the duty ratio will be explained.

An internal voltage dropping potential is gradually decreased because of leakage even on standby if current supply to the node 32 is stopped.

For example, assuming that the internal voltage dropping potential is 3.3 V, the capacitance of the node 32 is 100 pF, and the leakage current is 0.1 μA, the potential begins to decrease at a time constant 3.3 ms [$=3.3\ V \times 100\ pF \div 0.1\ \mu A$].

Thus, it is necessary to return the internal voltage dropping potential to a predetermined level by supplying an amount equivalent to the leakage before the internal voltage dropping potential is excessively decreased.

For example, if the internal voltage dropping circuit is stopped for 15 μs or shorter, the resultant potential drop is about 15 mV or under [$=3.3\ V \times \exp(-15\ \mu s/3.3\ ms)$].

Figure 5:
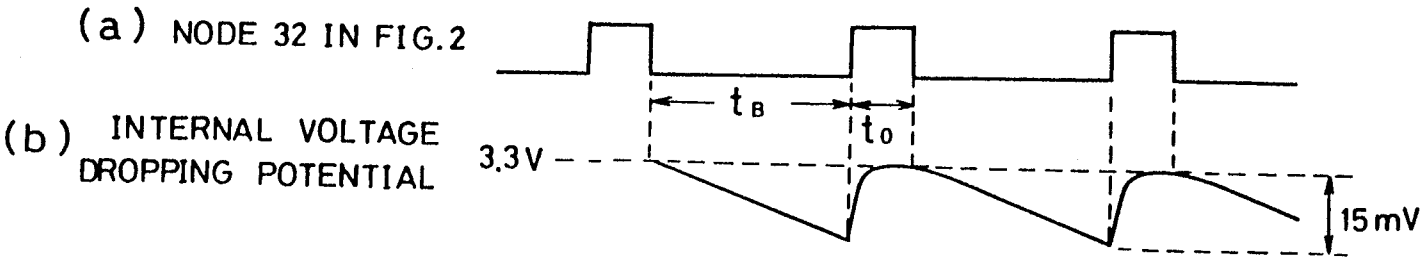
FIG. 5 is a waveform diagram for depicting a duty ratio of the embodiment.

Also, assuming that the time required for the internal voltage dropping circuit to recover to a potential reduced because of the leakage to a predetermined level is $t_A$, and a period for which the pulse signal remains high is $t_O$, $t_A < t_O$ is required. For example, assuming that $t_A = 30$ ns, the pulse signal shown in FIG. 5 may satisfy $t_B = 15\ \mu s$, $t_O = 1\ \mu s$, and the duty ratio of 1/16.

Although the ring oscillator 11 is used as an original pulse generator in the pulse signal generator 10 in this embodiment, it may be replaced by another circuit configuration. Alternative circuits may be substituted for the toggle-type flip-flops 13 as shown in FIG. 3.

Figure 6:
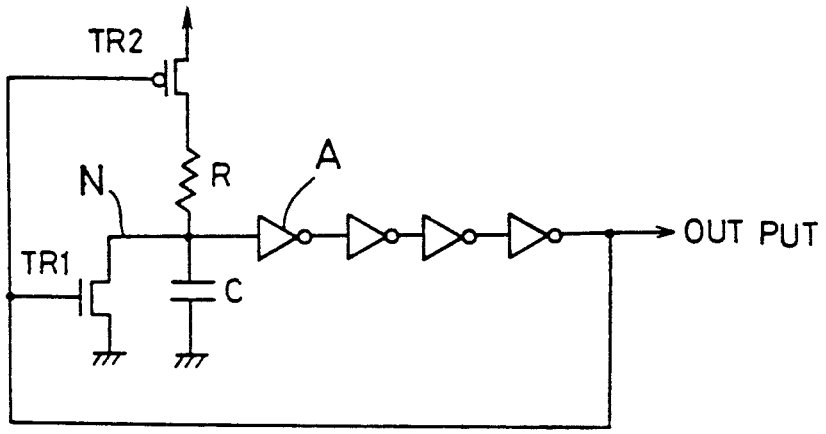
FIG. 6 is a circuit diagram showing another structure of a ring oscillator of the embodiment.
Figure 7:
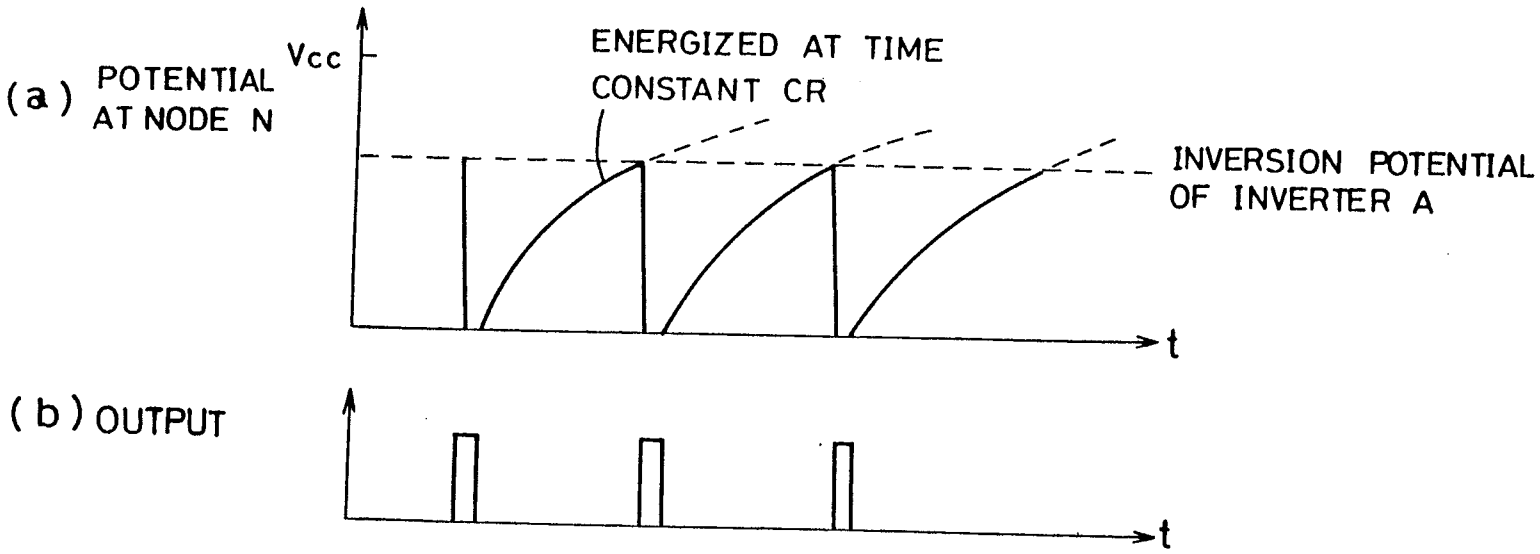
FIG. 7 is a waveform diagram showing an operation of the circuit in FIG. 6.

FIG. 6 is a circuit diagram showing another embodiment of the ring oscillator while FIG. 7 depicts waveforms generated thereby. In this circuit and as shown in FIG. 7, when the voltage applied from a resistance R to a capacitor C reaches an inversion potential of an inverter A which is a component of a delay circuit, a transistor TR1 is caused to be conductive to make the capacitor rapidly discharge, and after the discharge is completed, a transistor TR2 is activated to again charge the capacitor C. Repeating this procedure, an original pulse signal at a specified cycle can be gained similar to the ring oscillator 11 shown in FIG. 2.

Having thus shown and described what is considered to be the preferred embodiment for implementing the subject invention, it is to be noted that the same has been made by way of illustration and not limitation. Accordingly, all modifications, alterations and changes coming within the spirit and scope of the invention are herein meant to be included.

What is claimed is:

1. A control circuit for an internal voltage dropping circuit for a load including a semiconductor device, comprising pulse signal generating means for generating a pulse signal having a specified duty ratio, and switch means including an internal voltage dropping circuit connected to said pulse signal generating means and receiving a pulse signal produced by said pulse signal generating means to periodically activate said internal voltage dropping circuit in response to said pulse signal when the semiconductor device included in the load is on standby;

said internal voltage dropping circuit further comprising, a mirror type differential amplifier having a reference voltage input coupled to one side thereof and a supply voltage output, a first output transistor having a control electrode coupled to the other side of said differential amplifier and one current conduction electrode coupled between a supply voltage and said supply voltage output, first circuit means coupling to said pulse signal and including a relatively low controlled current path coupled between said differential amplifier and ground potential, second circuit means coupled to an activate/standby signal and including a relatively high controlled current path coupled between said differential amplifier and ground potential, and a second output transistor having a control electrode coupled to both said pulse signal and to said activate/standby signal and a pair of current conduction electrodes coupled between a supply voltage and the control electrode of said first output transistor.

2. The control circuit according to claim 1, wherein said pulse signal generating means includes an oscillator coupled to a binary counter circuit comprised of a plurality of series connected flip-flops, and wherein a first state flip-flop has an input connected to an output of said oscillator.

3. The control circuit according to claim 2 wherein said oscillator comprises a ring oscillator.

4. The control circuit according to claim 2 wherein each of said flip-flops includes an output and additionally including a multiple input binary logic gate including an input coupled to each said output of said flip-flops and having an output coupled to said relatively low controlled current path.

5. The control circuit according to claim 4 wherein said mirror type differential amplifier comprises a transistor differential amplifier.

6. The control circuit according to claim 6 wherein said relatively low controlled current path includes a current control transistor having a pair of current carrying electrodes coupled between said differential amplifier and ground potential and a control electrode coupled to the output of said binary logic gate.

7. The control circuit according to claim 6 wherein said logic gate comprises a coincidence type gate circuit.

8. The control circuit according to claim 6 wherein said logic gate comprises a NAND gate and additionally including a logic inverter coupled between an output of said NAND gate and the control electrode of said transistor.

9. The control circuit according to claim 4 wherein said relatively high controlled current path includes a current control transistor having a pair of current carrying electrode coupled between said differential amplifier and ground potential and a control electrode coupled to said activate/standby signal.

10. The control circuit according to claim 9 and additionally including another binary logic gate having a pair of inputs respectively coupled to said pulse signal and said activate/standby and an output coupled to the control electrode of said second output transistor.

11. The control circuit according to claim 10 wherein said another logic gate comprises a coincidence type gate circuit.

12. The control circuit according to claim 10 wherein said another logic gate comprises a NOR gate and additionally including a logic inverter coupled between an output of said NOR gate and the control electrode of said second output transistor.

13. The control circuit according to claim 1 wherein said mirror type differential amplifier includes a MOSFET type transistor circuit and said first and second output transistors comprise MOSFET type transistors.

* * * * *